US010518279B2

(12) United States Patent
Okude et al.

(10) Patent No.: US 10,518,279 B2
(45) Date of Patent: Dec. 31, 2019

(54) REFILLABLE CONTAINER

(71) Applicant: NIPPON PAPER INDUSTRIES CO., LTD, Tokyo (JP)

(72) Inventors: Hideki Okude, Tokyo (JP); Takaharu Noda, Tokyo (JP); Satoshi Tsuda, Tokyo (JP); Masatsugu Kato, Tokyo (JP); Eiji Kusano, Tokyo (JP); Satomi Morinaga, Tokyo (JP); Tatsuya Horikoshi, Tokyo (JP); Tadahira Yaguchi, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 15/322,864

(22) PCT Filed: Jun. 26, 2015

(86) PCT No.: PCT/JP2015/003219
§ 371 (c)(1),
(2) Date: Dec. 29, 2016

(87) PCT Pub. No.: WO2016/002179
PCT Pub. Date: Jan. 7, 2016

(65) Prior Publication Data

US 2017/0165694 A1 Jun. 15, 2017

(30) Foreign Application Priority Data

Jun. 30, 2014 (JP) ..... 2014-133693

(51) Int. Cl.
*B05B 11/00* (2006.01)
*B65D 77/06* (2006.01)
(Continued)

(52) U.S. Cl.
CPC ..... *B05B 11/0054* (2013.01); *A47K 5/1205* (2013.01); *B05B 11/3047* (2013.01);
(Continued)

(58) Field of Classification Search
CPC ..... B05B 11/0054; B05B 11/0097; B05B 11/3001; B05B 11/3045; B05B 11/0038;
(Continued)

(56) References Cited

U.S. PATENT DOCUMENTS 3,143,249 A * 8/1964 Merrill ..... B65D 77/065 222/105
3,171,571 A * 3/1965 Daniels ..... B65D 83/00 215/11.1

(Continued)

FOREIGN PATENT DOCUMENTS

JP 7-45088 12/1995
JP 7-330003 12/1995

(Continued)

OTHER PUBLICATIONS

International Search Report dated Aug. 11, 2015 in International Application No. PCT/JP2015/003219.

*Primary Examiner* — Paul R Durand
*Assistant Examiner* — Andrew P Bainbridge
(74) *Attorney, Agent, or Firm* — Wenderoth, Lind & Ponack, L.L.P.

(57) ABSTRACT

A refillable container including an outer container (3), a lid member (4), an inner container (5), and a pump (6). The outer container has an opening formed in an upper part thereof, and the lid member is configured to close the opening of the outer container. The inner container is made of paper, configured to store the liquid content therein, and replaceably accommodated in the outer container. The pump is configured to pump up the liquid content in the inner
(Continued)

container stored in the outer container and to dispense the liquid content outside of the refillable container. When the opening of the outer container is closed by the lid member, a suction tube (15) of the pump, which is arranged below the lid member, is inserted from a suction port (8), which is formed in an upper surface of the inner container, into the inner container.

2 Claims, 11 Drawing Sheets

(51) Int. Cl.
*B65D 83/00* (2006.01)
*A47K 5/12* (2006.01)
*B05B 15/30* (2018.01)

(52) U.S. Cl.
CPC ..... *B65D 77/06* (2013.01); *B65D 83/00* (2013.01); *B05B 11/0038* (2018.08); *B05B 15/30* (2018.02)

(58) Field of Classification Search
CPC ..... B05B 11/3047; B05B 15/30; B65D 77/06; B65D 5/74; B65D 83/00; B67D 7/06; B67D 7/78; A47K 5/1205
USPC ..... 222/80–91, 105, 183, 321.5, 377, 464.7, 222/541.1–541.2, 541.6, 182
See application file for complete search history.

(56) References Cited

U.S. PATENT DOCUMENTS 3,567,073 A * 3/1971 Friedenthal ..... B65D 5/0254 222/183
4,265,372 A * 5/1981 Wainberg ..... B05B 11/0043 222/82
4,907,722 A * 3/1990 Ueda ..... B67B 7/28 220/277
5,203,470 A * 4/1993 Brown ..... B65D 5/5405 222/105
5,255,813 A * 10/1993 Berggren ..... B65D 5/746 215/202
5,421,485 A * 6/1995 Furuta ..... B05B 11/0043 222/105
5,433,982 A * 7/1995 Yamada ..... B32B 27/08 428/35.7
5,497,909 A * 3/1996 Wirsig ..... B67B 7/26 222/82
5,526,958 A * 6/1996 Kuppersbusch ..... B65D 77/065 222/103
5,842,441 A * 12/1998 Gjerløv ..... A45D 19/00 119/650
5,851,608 A * 12/1998 Yamada ..... B32B 27/10 428/34.2
6,419,393 B1 * 7/2002 Shibata ..... B05B 11/0043 222/82
6,609,636 B1 * 8/2003 Petriekis ..... B65D 77/065 222/105
8,201,712 B2 * 6/2012 Freeman ..... B32B 1/02 222/386
8,474,655 B2 * 7/2013 Hackleman ..... B43L 25/00 222/105
8,757,440 B2 * 6/2014 Ouillette ..... B65D 5/5033 220/23.89
9,101,948 B2 * 8/2015 Baron ..... B05B 11/0037
10,376,910 B2 * 8/2019 Okude ..... B05B 11/3045
2005/0236427 A1 * 10/2005 Farha ..... B29C 49/221 222/105
2006/0243749 A1 * 11/2006 Robertson ..... B05B 11/0037 222/321.5
2009/0283541 A1 11/2009 Compton et al.
2010/0288794 A1 * 11/2010 Chapin ..... A47K 5/1202 222/377
2017/0225862 A1 * 8/2017 Schnabel ..... B65D 5/103
2018/0244426 A1 * 8/2018 Okude ..... B65D 5/74

FOREIGN PATENT DOCUMENTS

JP 10-147335 6/1998
WO 2009/139867 11/2009

* cited by examiner

REFILLABLE CONTAINER

TECHNICAL FIELD

The present invention relates to a refillable container capable of being refilled with a liquid content.

BACKGROUND ART

Hitherto, as a refillable container capable of being refilled with a liquid content, there has been proposed a refillable container including a paper tube body, a fixing portion, a pouch, and a pump member. The paper tube body has space formed therein. The fixing portion is connected to an inner upper part of the paper tube body, and has a protruding portion formed along an outer peripheral surface of an upper part of the fixing portion. The pouch is configured to store a liquid content, and is removably connected to a lower part of the fixing portion through a screw connection so that the pouch is replaceable when the liquid content is used up. The pump member is connected to an upper end of the fixing portion, and is configured to pump up the content stored in the pouch and to dispense the content to an outside through pumping action (see, for example, Patent Literature 1).

In the refillable container disclosed in Patent Literature 1, when the liquid content in the pouch is used up, the fixing portion is disconnected from the paper tube body, and the pouch connected to the fixing portion is taken out from the paper tube body. Then, the screw connection is released to take out the pouch from the fixing portion, and the pouch is replaced with a new pouch. In this manner, refilling is performed.

CITATION LIST

Patent Literature

[PTL 1] JP 2013-500907 A1

SUMMARY OF INVENTION

Technical Problem

However, in the refillable container disclosed in Patent Literature 1, when the liquid content in the pouch is used up, the fixing portion is disconnected from the paper tube body, and the pouch connected to the fixing portion is taken out from the paper tube body. Then, the screw connection is released to take out the pouch from the fixing portion, and the pouch is replaced with a new pouch. Thus, there is a problem of a laborious refilling operation.

Further, although not particularly defined in Patent Literature 1, the pouch configured to store the liquid content is assumed to be made of a synthetic resin. In a case where the pouch is made of a synthetic resin, a used pouch after replacement is difficult to recycling. Thus, there is a problem of resource wasting.

Further, the body, which is an outer container configured to accommodate the pouch, is made of paper. Thus, there is a problem in that, when the refillable container is used in a bathroom or a lavatory, and the body is wetted, the body loses its shape and cannot be used repeatedly in some cases.

It is an object of the present invention to provide a refillable container enabling that a refilling operation is easily performed when the liquid content is used up, that an inner container configured to store the liquid content is resource saving, and that an outer container is used repeatedly even at a place where the outer container is liable to be wetted.

Solution to Problem

In order to achieve the above-mentioned object, according to the invention as described in claim 1, there is provided a refillable container, including: an outer container, which has an opening on an upper part thereof and is made of plastic; a lid member, which is configured to close the opening of the outer container and is made of plastic; an inner container, which is made of paper, configured to store a liquid content therein, and replaceably accommodated in the outer container when the liquid content is used up, the inner container having a suction port formed in an upper surface of the inner container; and a pump, which is provided to the lid member and configured to pump up the liquid content in the inner container accommodated in the outer container and to dispense the liquid content to an outside of the refillable container, in which the pump includes: a tubular cylinder portion; a dispense nozzle, which is provided to an upper part of the tubular cylinder portion and serves also as an operation portion for a piston that is slidably fitted into the tubular cylinder portion; and a suction tube, which is provided to a lower part of the tubular cylinder portion, in which the tubular cylinder portion penetrates the lid member, and is fixed to the lid member, in which the dispense nozzle is arranged above the lid member, and the suction tube is arranged below the lid member, and in which, when the opening of the outer container is closed by the lid member, the suction tube arranged below the lid member is inserted from the suction port, which is formed in the upper surface of the inner container, into the inner container.

According to an aspect of the invention, the suction port formed in the upper surface of the inner container accommodated in the outer container and the suction tube arranged below the lid member are arranged to be positioned on the same imaginary line in a vertical direction of the refillable container.

According to another aspect of the invention, the suction port formed in the upper surface of the inner container is sealed by a film, which is tearable, and, when the opening of the outer container is closed by the lid member, the suction tube arranged below the lid member tears the film so as to be inserted into the inner container.

According to another aspect of the invention, the suction port formed in the upper surface of the inner container is formed at a center of the upper surface.

According to another aspect of the invention, a bottom surface of the inner container, is formed into a reversed quadrangular pyramid shape.

According to another aspect of the invention, the inner container is made of a paper material having a thermoplastic resin laminated on its both surfaces, includes four body panels, and has a body, which has an edge coupled to a vertical direction sealing panel so as to be formed into a square tubular shape, in which, in the upper surface of the inner container, a pair of upper-surface forming panels and a pair of side panels are continuously provided to upper edges of the four body panels, in which the pair of upper-surface forming panels face each other and overlap in the vertical direction, in which the pair of side panels are positioned between the pair of upper-surface forming panels to face each other and folded up along with overlapping of the pair of upper-surface forming panels, in which the pair of upper-surface forming panels have holes, which are formed at centers of the pair of upper-surface forming panels to be the suction port, in which one of the holes, which is formed in at least a lower upper-surface forming panel of the pair of upper-surface forming panels, is sealed by the film, which is tearable, and in which a periphery of the lower upper-surface forming panel of the pair of upper-surface forming panels, an upper upper-surface forming panel of the pair of upper-surface forming panels, and the pair of side surface panels are bonded to each other to seal the inner container.

According to another aspect of the invention, the inner container is made of a paper material having a thermoplastic resin laminated on its both surfaces, includes the four body panels, and has the body, which has the edge coupled to the vertical direction sealing panel so as to be formed into a square tubular shape, in which, in the bottom surface of the inner container, a pair of gable roof-shaped bottom surface forming panels and a pair of gable wall-shaped bottom surface forming panels are continuously provided to lower edges of the four body panels, in which the pair of gable roof-shaped bottom surface forming panels face each other, and have outer sealing panels, which have a belt-like shape, at lower portions thereof, in which the pair of gable wall-shaped bottom surface forming panels face each other, and have inner sealing panels, which have a belt-like shape and a height smaller than that of the outer sealing panels, in which the pair of gable wall-shaped bottom surface forming panels are folded in between the pair of gable roof-shaped bottom surface forming panels, and facing surfaces of the outer sealing panels, which face each other, are bonded to each other to seal the inner container, and in which facing surfaces of the outer sealing panels and the inner sealing panels, and facing surfaces of the inner sealing panels are bonded to each other to seal the inner container.

Advantageous Effects of Invention

According to the refillable container of an aspect of the invention, refilling of the liquid content is performed as described below. When the liquid content in the inner container is used up, the lid member is disconnected from the outer container. Through an action of disconnecting the lid member, the suction tube of the pump provided to the lid member is taken out from the inner container accommodated in the outer container, and the inner container, in which the liquid content is used up, is taken out from the outer container. Thereafter, a new inner container, which stores the liquid content, is accommodated in the outer container. The suction port of the pump is inserted from the suction port, which is formed in the upper surface of the inner container accommodated in the outer container, into the inner container. Accordingly, refilling of the liquid content can easily be performed through a simple operation of placing the lid member on the outer container.

Further, the inner container is made of paper. Thus, a used inner container is recyclable, and hence the present invention can contribute to resource saving.

Further, the outer container is made of plastic. Thus, the outer container can be used repeatedly for a long period of time at a place where the outer container is liable to be wetted. Therefore, the present invention is economical.

According to the refillable container of another aspect of the invention, the suction port formed in the upper surface of the inner container accommodated in the outer container and the suction tube arranged below the lid member are arranged to be positioned on the same imaginary line in a vertical direction. Thus, when the lid member is positioned on the opening of the outer container, a distal end of the suction tube arranged below the lid member matches with the suction port formed in the upper surface of the inner container accommodated in the outer container. Therefore, through the simple action of placing the lid member on the outer container, the suction tube can be inserted into the inner container through the suction port formed in the upper surface of the inner container. Thus, a refilling operation of the liquid content can be performed more easily.

According to the refillable container of another aspect of the invention, the suction port formed in the upper surface of the inner container is sealed by the film, which is tearable. When the opening of the outer container is closed by the lid member, the suction tube arranged below the lid member tears the film so as to be inserted into the inner container. Thus, the refilling operation of the liquid content can be performed more easily.

According to the refillable container of another aspect of the invention, the suction port formed in the upper surface of the inner container is formed at the center of the upper surface, and the pump, which is configured to pump up the liquid content in the inner container accommodated in the outer container and to dispense the liquid content, is provided at the center of the lid member of the outer container. Accordingly, irrespective of the orientation of the lid member configured to close the opening of the outer container, when the opening of the outer container is closed by the lid member, the suction tube arranged below the lid member is reliably inserted from the suction port, which is formed in the upper surface of the inner container, into the inner container. Thus, the refilling operation of the liquid content can be performed more easily.

According to the refillable container of another aspect of the invention, the bottom surface of the inner container is formed into a reversed quadrangular pyramid shape. Accordingly, when the liquid content is reduced to a small amount, the liquid content in the inner container is accumulated at an apex of the reversed quadrangular pyramid shape in the bottom surface. When the opening of the outer container is closed by the lid member, and the suction tube arranged below the lid member is inserted into the inner container, if the distal end of the suction tube is set to be positioned at the apex of the reversed quadrangular pyramid shape in the bottom surface of the inner container, the liquid content in the inner container can be reliably and thoroughly sucked out.

According to the refillable container of another aspect of the invention, the inner container is made of a paper material having a thermoplastic resin laminated on its both surfaces, and includes the four body panels. The inner container has the body, which has the edge coupled to the vertical direction sealing panel so as to be formed into a square tubular shape. In the upper surface, the pair of upper-surface forming panels and the pair of side surface panels are continuously provided to the upper edges of the body panels. The pair of upper-surface forming panels face each other and overlap in the vertical direction. The pair of side surface panels are positioned between the pair of upper-surface forming panels to face each other, and folded along with overlapping of the pair of upper-surface forming panels. The holes, which are positioned at the centers of the pair of upper-surface forming panels so as to be the suction port, are formed. Thus, the suction port can easily be formed at the center of the upper surface of the inner container.

Further, the hole formed in at least the lower upper-surface forming panel of the pair of upper-surface forming panels is sealed by the film, which is tearable. The periphery of the lower upper-surface forming panel of the pair of upper-surface forming panels, the upper upper-surface forming panel of the pair of upper-surface forming panels, and the pair of side surface panels are bonded to each other to seal the inner container. Accordingly, the liquid content is in the state of being sealed in the inner container. When the opening of the outer container is closed by the lid member, the suction tube arranged below the lid member can be inserted from the suction port, which is formed in the upper surface of the inner container, into the inner container.

According to the refillable container of another aspect of the invention, the inner container is made of a paper material having a thermoplastic resin laminated on its both surfaces, and includes the four body panels. The inner container has the body, which has the edge couple to the vertical direction sealing panel so as to be formed into a square tubular shape. In the bottom surface, the pair of gable roof-shaped bottom surface forming panels and the pair of gable wall-shaped bottom surface forming panels are continuously provided to the lower edges of the body panels. The gable roof-shaped bottom surface forming panels face each other, and have the outer sealing panels, which have a belt-like shape, at the lower portions thereof. The gable wall-shaped bottom surface forming panels face each other, and have the inner sealing panels, which have a belt-like shape and a height smaller than that of the outer sealing panels. The gable wall-shaped bottom surface forming panels are folded in between the gable roof-shaped bottom surface forming panels, and the facing surfaces of the outer sealing panels, which face each other, are bonded to each other to seal the inner container. The facing surfaces of the outer sealing panels and the inner sealing panels, and the facing surfaces of the inner sealing panels are bonded to each other to seal the inner container. Thus, the bottom surface of the inner container can easily be formed into a reversed quadrangular pyramid shape.

DESCRIPTION OF EMBODIMENTS

Now, one example of a refillable container according to an embodiment of the present invention is described in detail with reference to the drawings.

Figure 1:
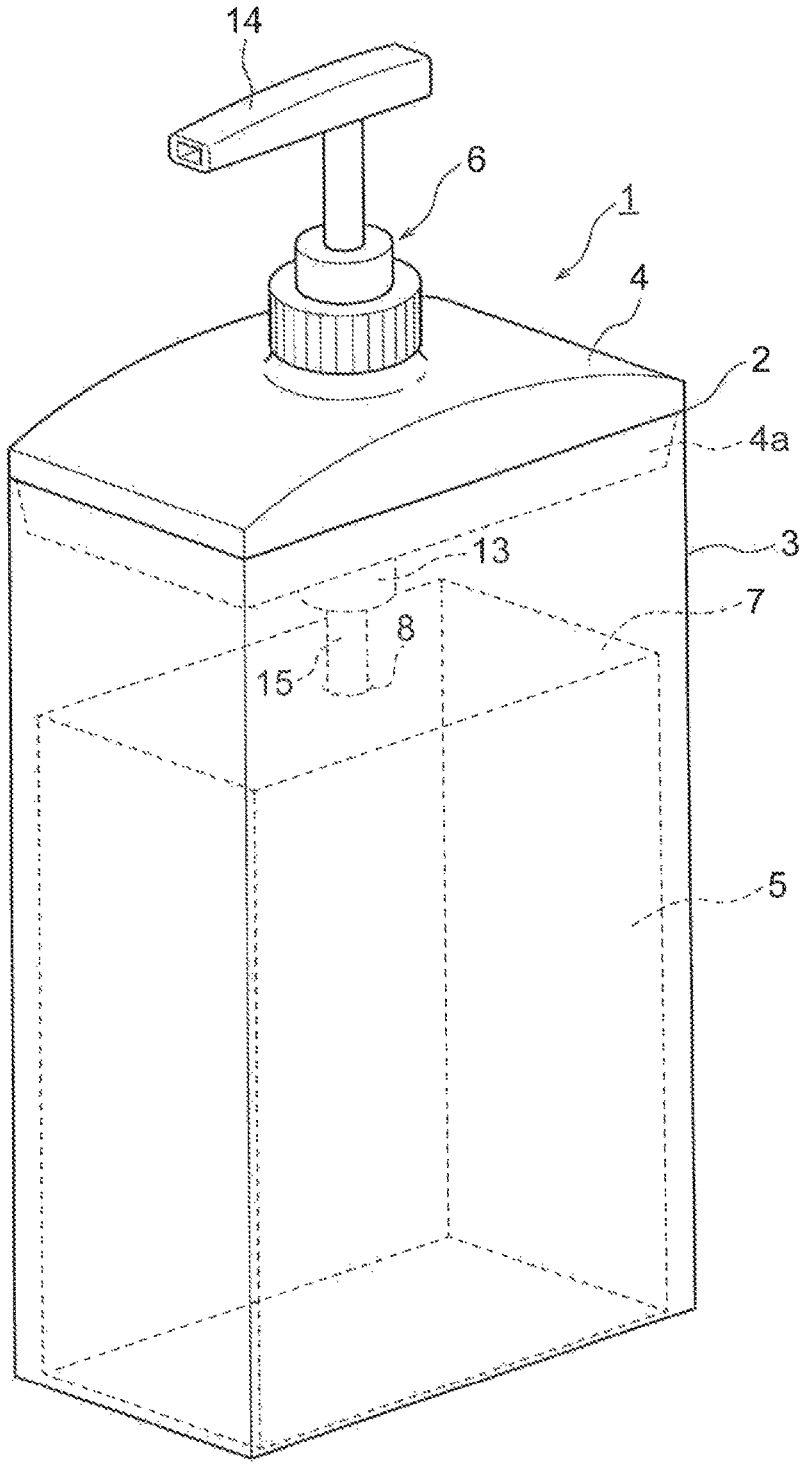
FIG. 1 is a perspective view for illustrating one example of a refillable container according to an embodiment of the present invention.
Figure 2:
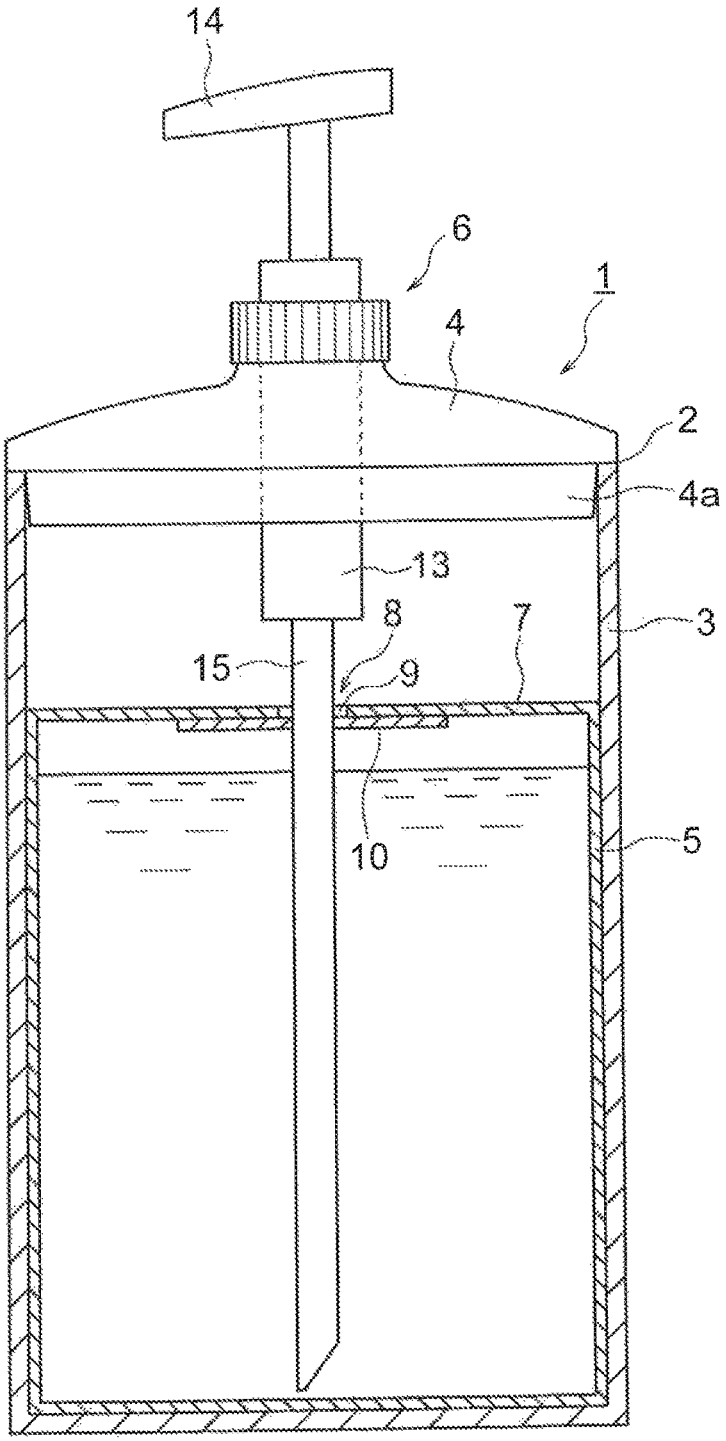
FIG. 2 is a vertical sectional view of the refillable container illustrated in FIG. 1.
Figure 3:
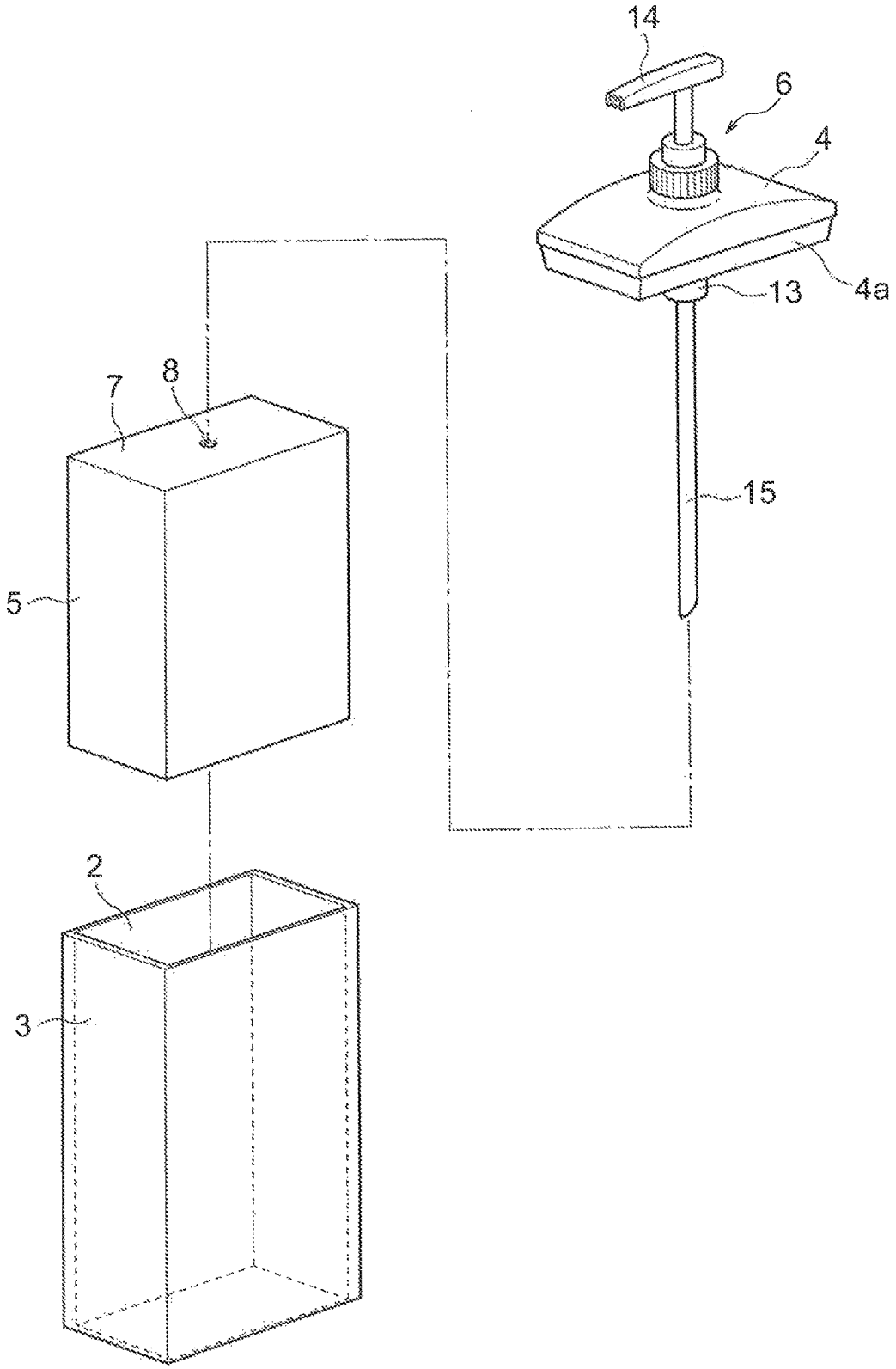
FIG. 3 is an exploded perspective view of the refillable container illustrated in FIG. 1.
Figure 4:
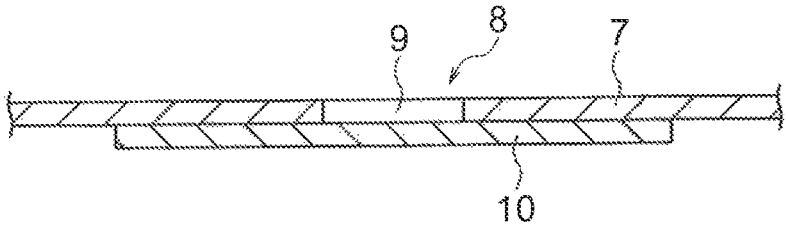
FIG. 4 is an enlarged sectional view for illustrating one example of a suction port formed in an upper surface of an inner container.
Figure 5:
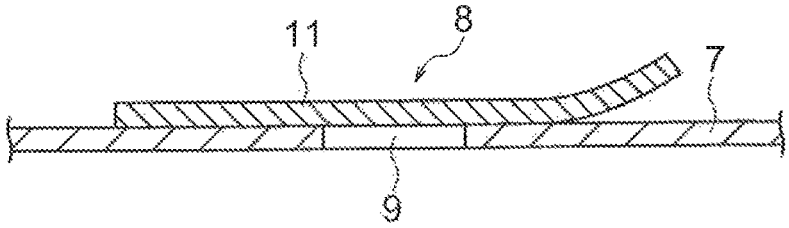
FIG. 5 is an enlarged sectional view for illustrating another example of the suction port formed in the upper surface of the inner container.
Figure 6A:
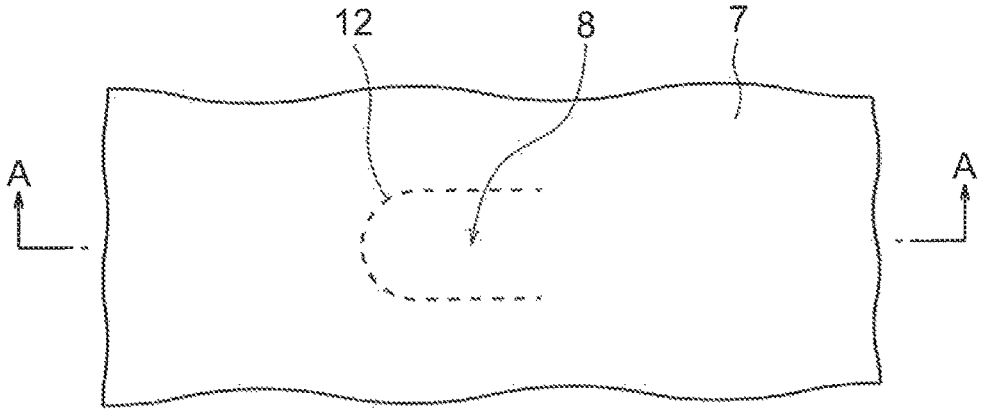
FIG. 6A is an enlarged plan view for illustrating another example of the suction port formed in the upper surface of the inner container.
Figure 6B:
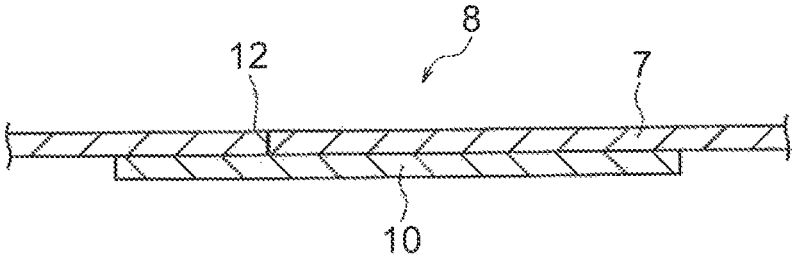
FIG. 6B is a sectional view taken along the line A-A of FIG. 6A.

FIG. 1 is a perspective view for illustrating one example of the refillable container according to the embodiment of the present invention. FIG. 2 is a vertical sectional view of the refillable container illustrated in FIG. 1. FIG. 3 is an exploded perspective view of the refillable container illustrated in FIG. 1. FIG. 4 is an enlarged sectional view for illustrating one example of a suction port formed in an upper surface of an inner container. FIG. 5 is an enlarged sectional view for illustrating another example of the suction port formed in the upper surface of the inner container. FIG. 6 are views for illustrating another example of the suction port formed in the upper surface of the inner container. FIG. 6A is an enlarged plan view, and FIG. 6B is a sectional view taken along the line A-A of FIG. 6A.

A refillable container 1 in this embodiment includes an outer container 3, a lid member 4, an inner container 5, and a pump 6. The outer container 3 has an opening 2 formed in an upper part of the outer container 3, and is made of plastic. The lid member 4 is configured to close the opening 2 of the outer container 3, and is made of plastic. The inner container 5 is configured to store a liquid content such as shampoo and liquid soap therein, and is to be replaceably accommodated in the outer container 3 when the liquid content is used up. The inner container 5 is made of paper. The pump 6 is provided to the lid member 4, and is configured to pump up the liquid content in the inner container 5 accommodated in the outer container 3 and to dispense the liquid content to an outside.

In this example, the outer container 3 is made of transparent plastic. However, its material is not limited to be transparent. Further, the outer container 3 has a shape of a bottomed square pipe. However, its shape is not particularly limited.

Further, a fitting portion 4*a* is provided to a lower part of the lid member 4. The fitting portion 4*a* is to be removably fitted to the opening 2, which is formed in the upper part of the outer container 3, to close the opening 2. In this example, the fitting portion 4*a* is to be liquid-tightly fitted to the opening 2.

Further, in this example, the inner container 5 is formed into a brick shape with a paper material having a thermoplastic resin layer at least on an inner surface of a paper base. A suction port 8 is formed in an upper surface 7 of the inner container 5. As for the suction port 8, a hole 9 being the suction port 8 is formed in the upper surface 7. A film 10, which is tearable, is provided to a back surface of the upper surface 7 so as to seal the hole 9 (see FIG. 4). A suction tube of the pump 6, which is described later, is stuck into the film 10 so as to tear the film 10.

In this example, the film 10 configured to seal the hole 9 is provided to the back surface of the upper surface 7, but not limited thereto. The film 10 may be provided to a front surface of the upper surface 7. Further, the film 10 may be provided to each of the front surface and the back surface of the upper surface 7.

A known film, such as polyethylene, polypropylene, polyester, or cellophane may be used as the film 10, but not particularly limited thereto. When the film 10 is a thermoplastic resin, the hole 9 formed in the upper surface portion 7 can be easily sealed by heat sealing.

In addition, aluminum foil, paper, or the like may be laminated on the film 10 in order to improve tearability, light-blocking property, oxygen barrier property, or the like.

The suction port 8 is not limited to the above-mentioned configuration. For example, as illustrated in FIG. 5, the hole 9 being the suction port 8 may be formed in the upper surface 7, and a sealing piece 11 may peelably be provided to the front surface of the upper surface so as to seal the hole 9. Further, as illustrated in FIG. 6, there may be employed a configuration in which the hole 9 being the suction port 8 is formed in the upper surface 7 with perforations 12 except for a certain part, and in which the film 10, which is tearable, is provided to the back surface of the upper surface 7 so as to seal the hole 9 formed with the perforations 12.

Further, the inner container 5 is positioned so as not to move in the outer container 3 and accommodated in the outer container 3. In this example, a shape of a cross section of the inner container 5 is formed so as to be substantially similar to a shape of an inner cross section of the outer container 3. The inner container 5 accommodated in the outer container 3 has an outer surface which is supported by an inner surface of the outer container 3 so as to be positioned in the outer container 3.

Further, the pump 6 includes a tubular cylinder portion 13, a dispense nozzle 14, and a suction tube 15. The dispense nozzle 14 is provided to an upper part of the tubular cylinder portion 13, and serves also as an operation portion for a piston that is slidably fitted into the tubular cylinder portion 13. The suction tube 15 is provided to a lower part of the tubular cylinder portion. Further, the tubular cylinder portion 13 penetrates the lid member 4, and is fixed to the lid member 4. The dispense nozzle 14 is arranged above the lid member 4. The suction tube 15 is arranged below the lid member 4.

Further, when the opening 2 of the outer container 3 is closed by the lid member 4, the suction tube 15 arranged below the lid member 4 is inserted from the suction port 8, which is formed in the upper surface 7 of the inner container 5, into the inner container 5.

In this example, the suction port 8, which is formed in the upper surface 7 of the inner container 5 accommodated in the outer container 3, and the suction tube 15, which is arranged below the lid member 4, are arranged so as to be positioned on the same imaginary line in a vertical direction. Further, when the opening 2 of the outer container 3 is closed by the lid member 4, the suction tube 15 arranged below the lid member 4 tears the film 10, which seals the hole 9 being the suction port 8 formed in the upper surface 7, to thereby be inserted into the inner container 5.

In the refillable container 1 configured as described above, refilling of the liquid content is performed as described below.

After the liquid content in the inner container 5 is used up, the lid member 4 is disconnected from the outer container 3, and the suction tube 15 of the pump 6 provided to the lid member 4 is taken out from the inner container 5 accommodated in the outer container 3. Then the inner container 5 in which the liquid content is used up is taken out from the outer container 3.

Then, a new inner container 5, which stores the liquid content, is accommodated in the outer container 3. The lid member 4 covers the outer container 3 so that the suction tube 15 of the pump 6 is inserted from the suction port 8, which is formed in the upper surface 7 of the inner container 5 accommodated in the outer container 3, into the inner container 5. In this manner, a refilling operation is terminated.

As described above, according to the refillable container 1 of the present invention, in the refilling of the liquid content, an action of disconnecting the lid member 4 from the outer container 3 and an action of taking out the suction tube 15 of the pump 6 provided to the lid member 4 from the inner container 5 can be performed through a single action of disconnecting the lid member 4 from the outer container 3.

In this example, the suction port 8 formed in the upper surface 7 of the inner container 5, which is positioned in the outer container 3 and accommodated in the outer container 3, and the suction tube 15 arranged below the lid member 4 are arranged so as to be positioned on the same imaginary line in the vertical direction. Thus, when the lid member 4 is positioned on the opening 2 of the outer container 3, a distal end of the suction tube 15 arranged below the lid member 4 matches with the suction port 8 formed in the upper surface 7 of the inner container 5 accommodated in the outer container 3. Therefore, through a simple action of placing the lid member 4 on the outer container 3, the suction tube 15 can be inserted into the inner container 5 through the suction port 8 formed in the upper surface 7 of the inner container 5.

Further, in this example, when the opening 2 of the outer container 3 is closed by the lid member 4, the suction tube 15 arranged below the lid member 4 tears the film 10, which seals the hole 9 being the suction port 8 formed in the upper surface 7, to thereby be inserted into the inner container 5. Thus, through a single action of closing the opening 2 of the outer container 3 by the lid member 4, insertion of the suction tube 15 arranged below the lid member 4 into the inner container 5 and closing of the opening 2 of the outer container 3 can be performed simultaneously.

Further, the inner container 5 is made of paper. Thus, the used inner container 5 is recyclable, and hence the present invention can contribute to resource saving. Further, the outer container 3 is made of plastic. Thus, the outer container 3 can be used repeatedly for a long period of time at a place where the outer container 3 is liable to be wetted.

Figure 7:
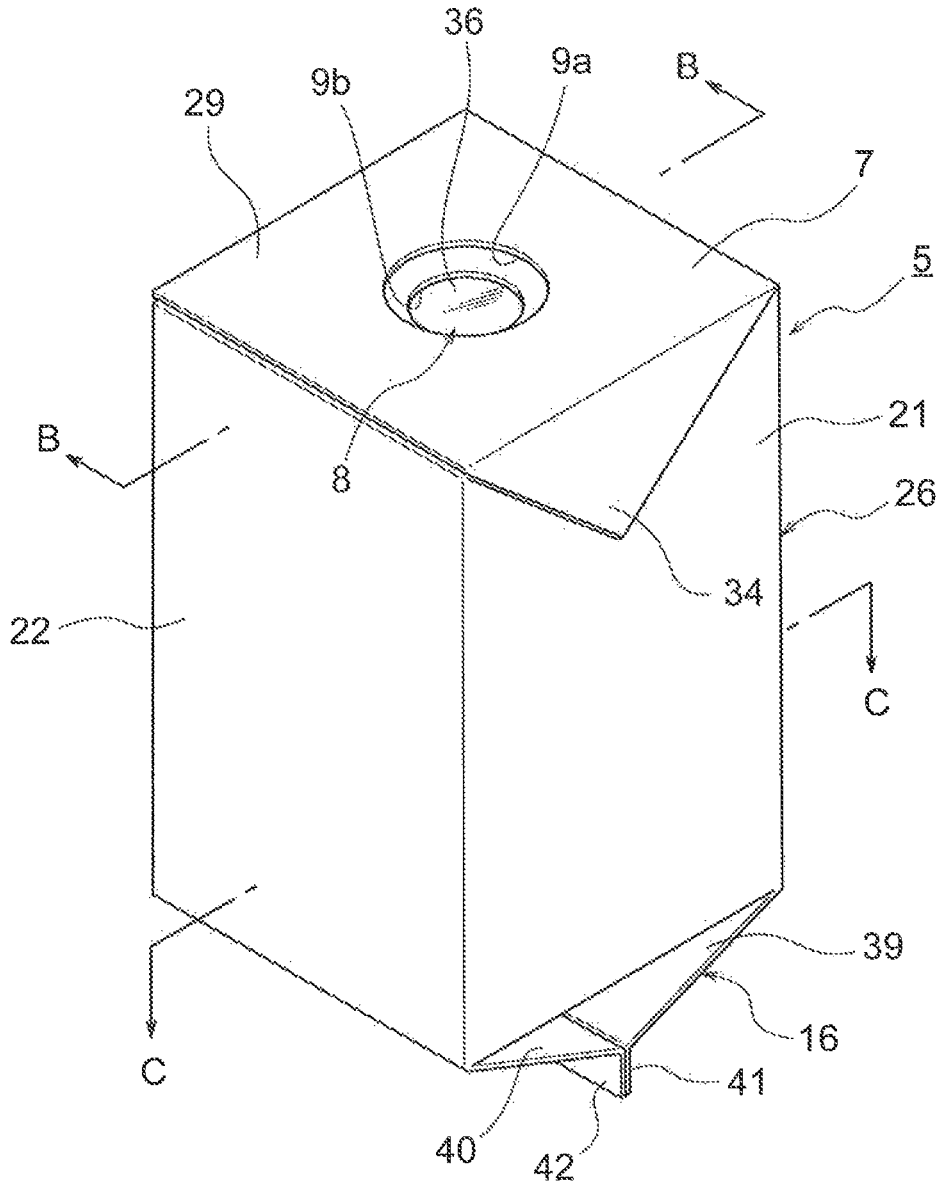
FIG. 7 is a perspective view for illustrating another example of the inner container in the refillable container according to the present invention.
Figure 8:
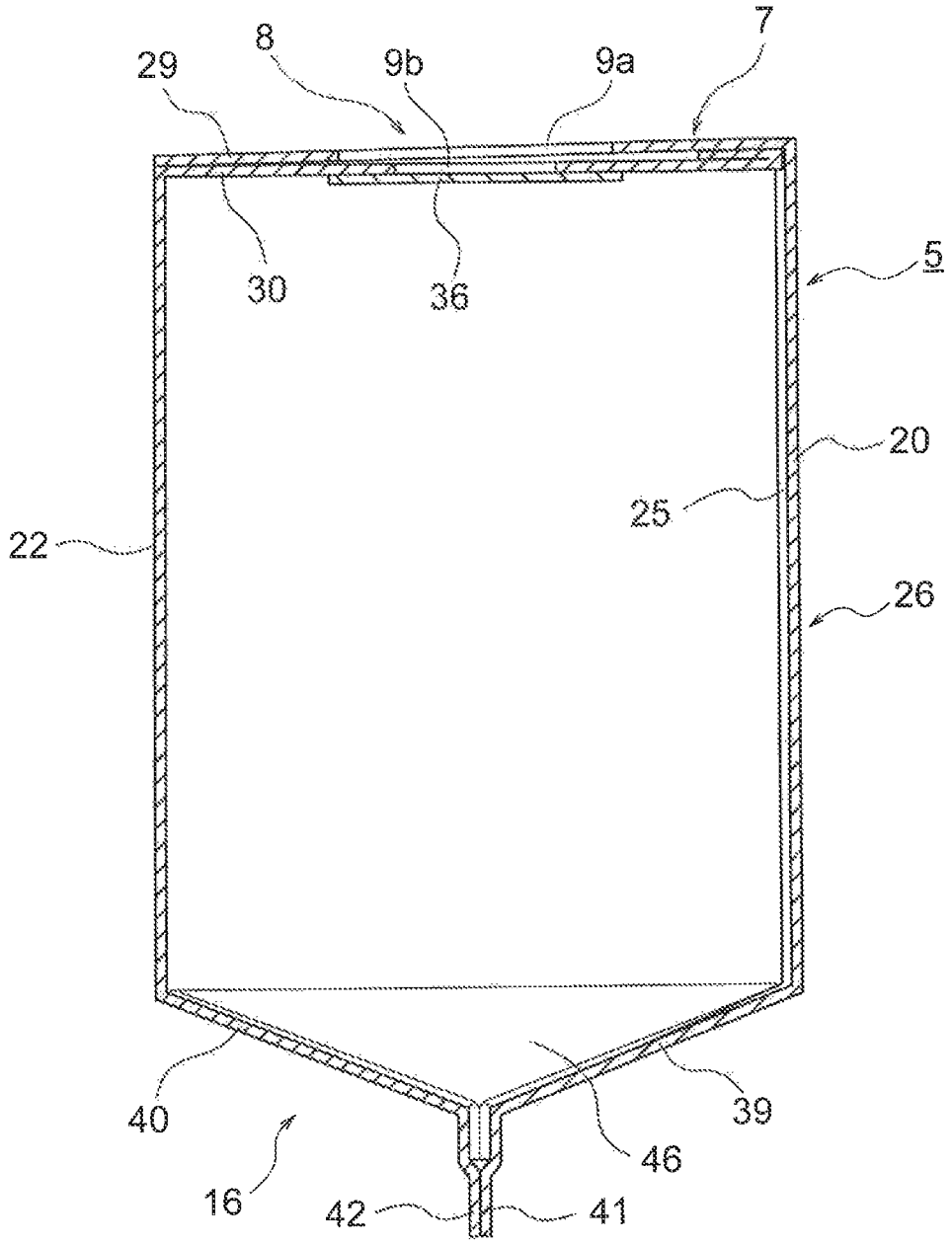
FIG. 8 is a sectional view taken along the line B-B of FIG. 7.
Figure 9:
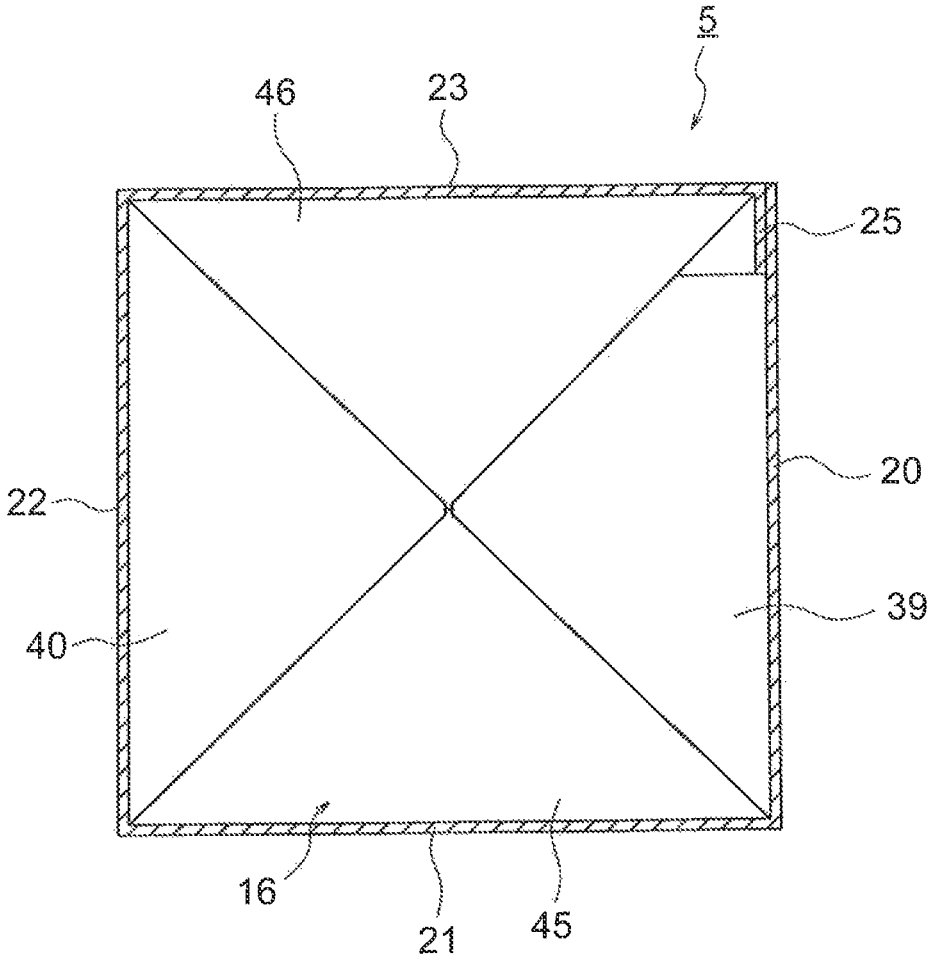
FIG. 9 is a sectional view taken along the line C-C of FIG. 7.
Figure 10:
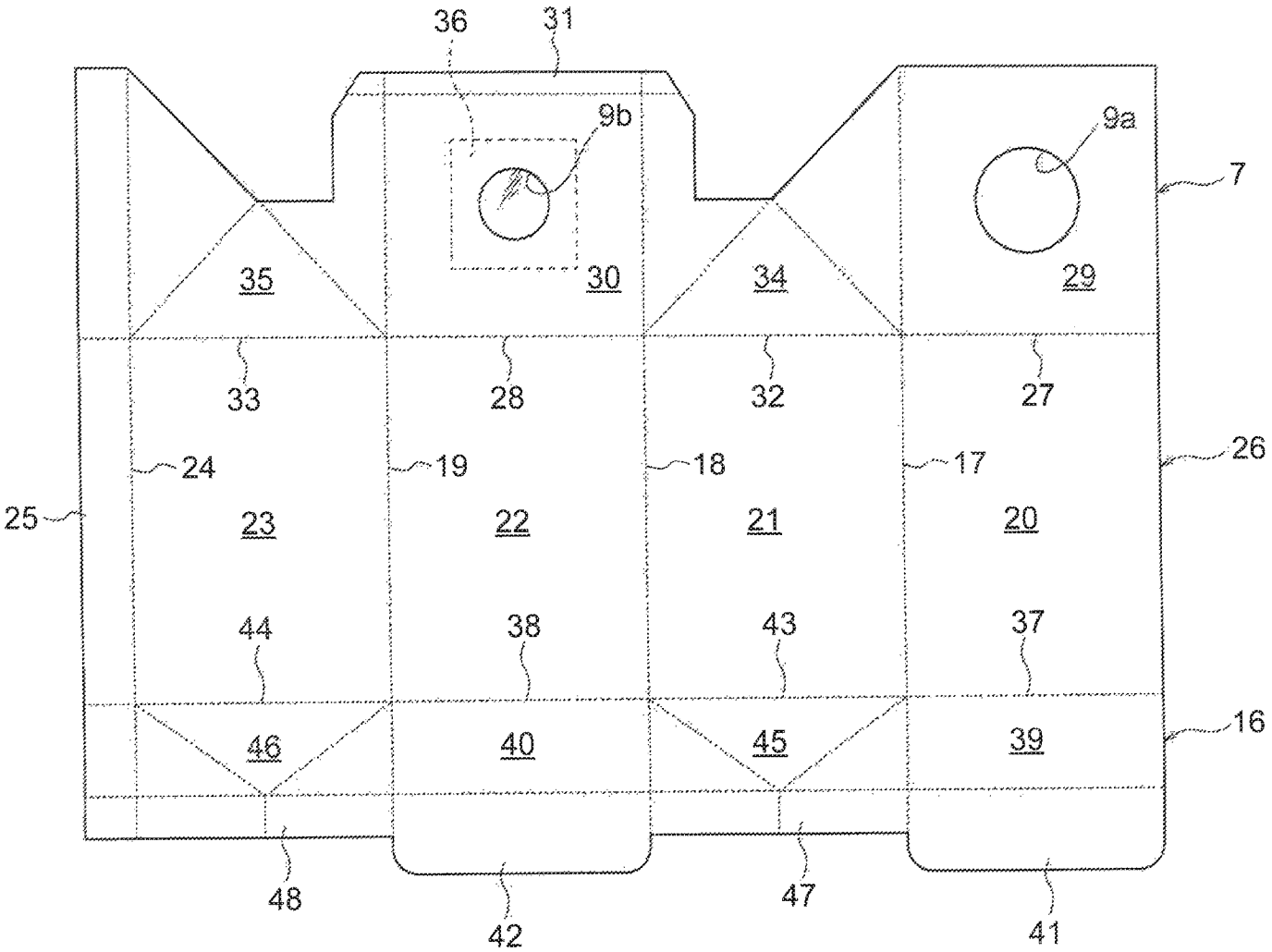
FIG. 10 is a developed view for illustrating carton blank before being subjected to assembly processing of the inner container illustrated in FIG. 7.
Figure 11:
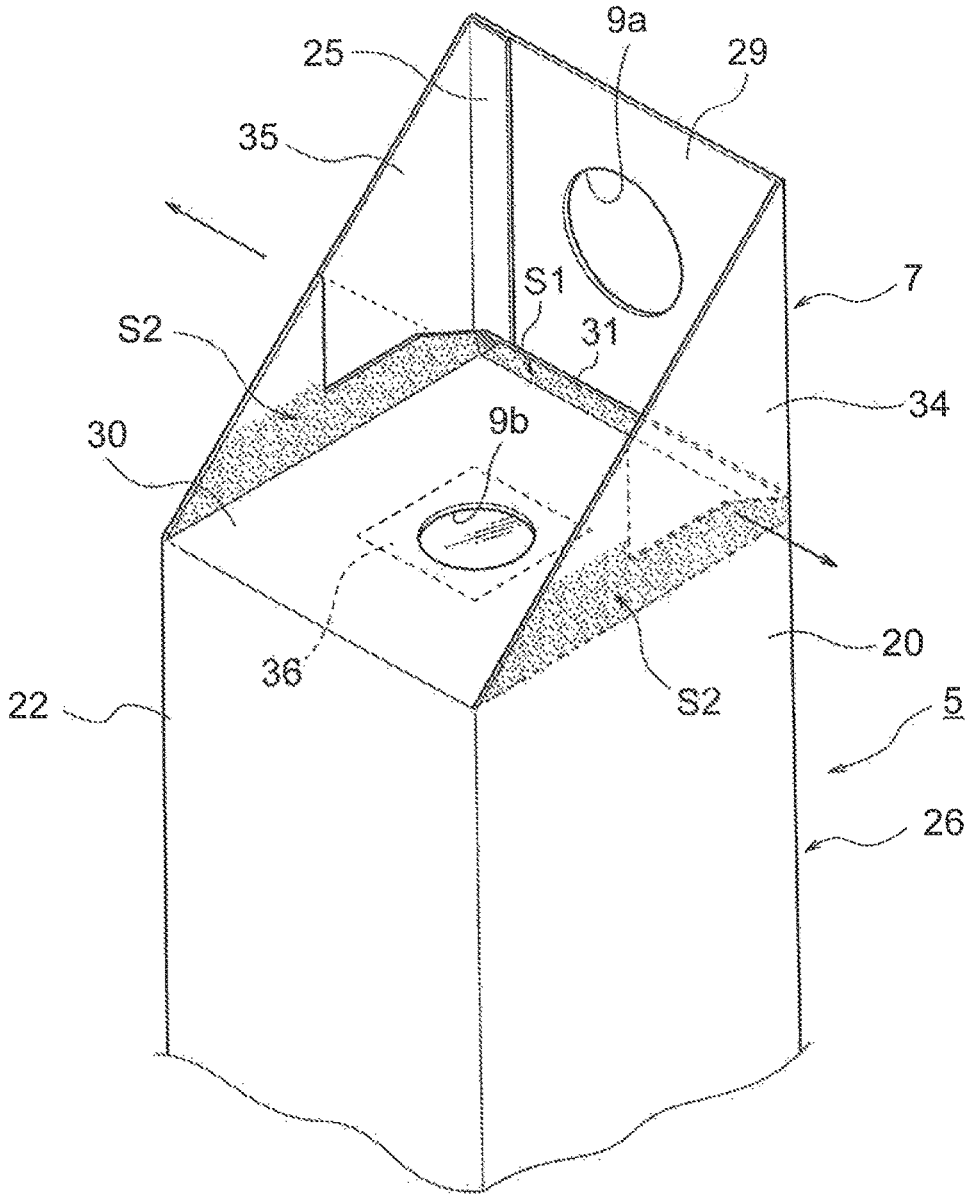
FIG. 11 is an explanatory view for illustrating a step of forming an upper surface of the inner container illustrated in FIG. 7.
Figure 12:
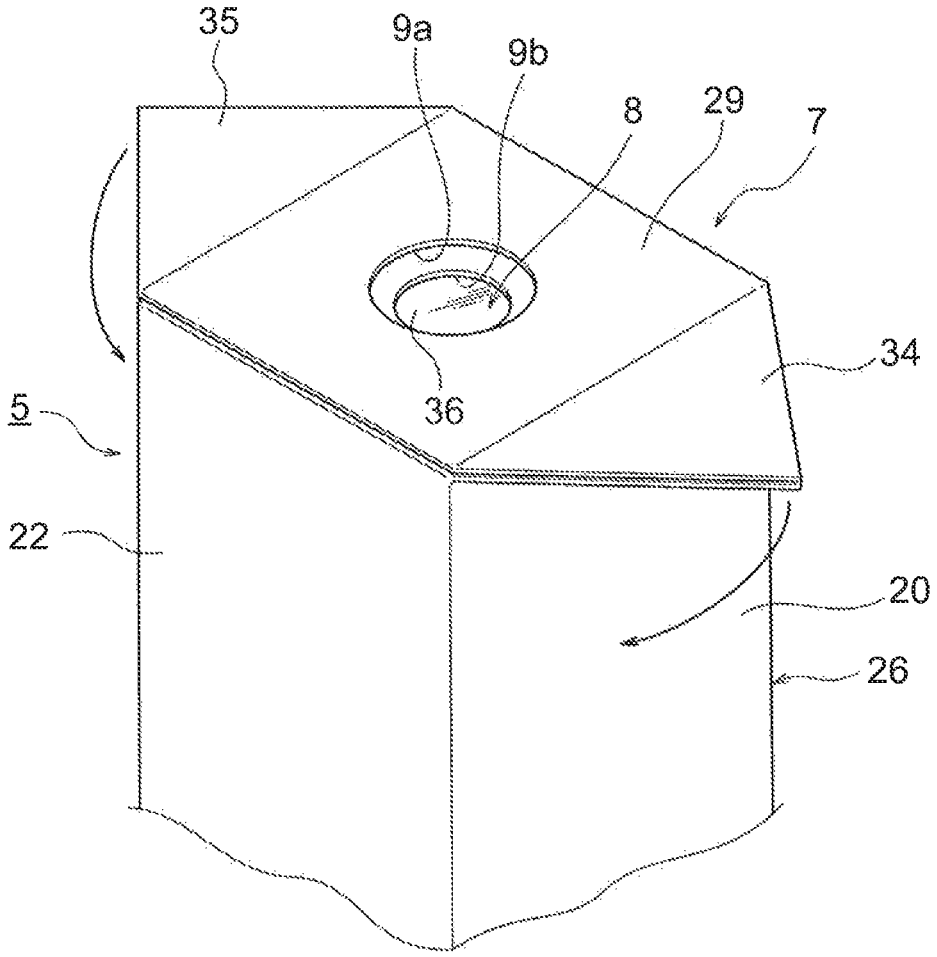
FIG. 12 is an explanatory view for illustrating the step of forming the upper surface of the inner container illustrated in FIG. 7.
Figure 13:
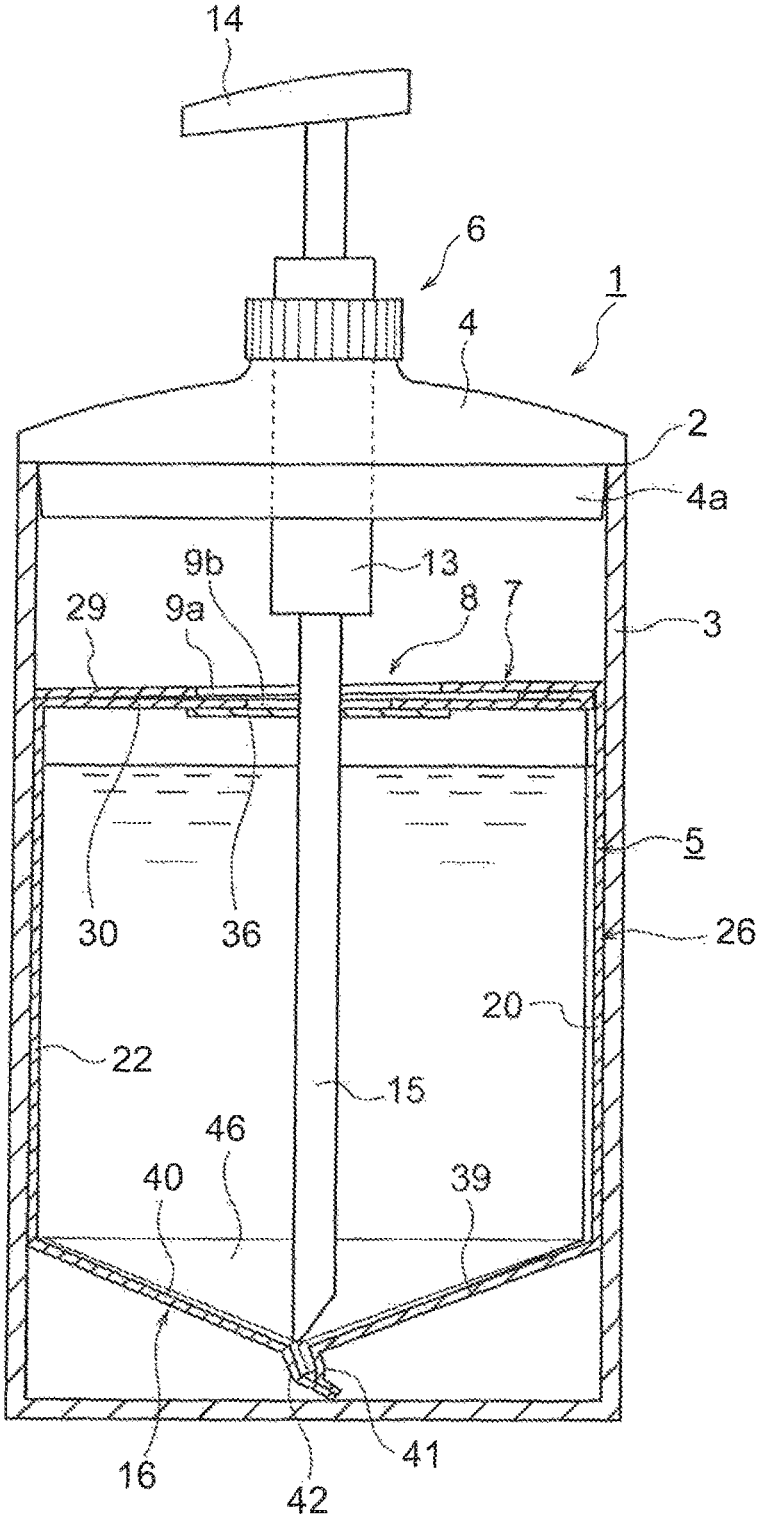
FIG. 13 is a vertical sectional view of the refillable container in which an outer container accommodates the inner container illustrated in FIG. 7.

FIG. 7 is a perspective view for illustrating another example of the inner container in the refillable container according to the present invention. FIG. 8 is a sectional view taken along the line B-B of FIG. 7. FIG. 9 is a sectional view taken along the line C-C of FIG. 7. FIG. 10 is a developed view for illustrating carton blank before being subjected to assembly processing of the inner container illustrated in FIG. 7. FIG. 11 and FIG. 12 are explanatory views for illustrating a step of forming the upper surface of the inner container illustrated in FIG. 7. FIG. 13 is a vertical sectional view of the refillable container in which the outer container accommodates the inner container illustrated in FIG. 7.

In the inner container 5 of this example, the suction port 8 formed in the upper surface 7 is formed at a center of the upper surface 7. Further, as illustrated in FIG. 8 and FIG. 9, a bottom surface 16 of the inner container 5 is formed into a reversed quadrangular pyramid shape.

One example of the inner container 5 in this example is described. The inner container 5 is made of a paper material having a thermoplastic resin laminated on its both surfaces, and includes four body panels 20, 21, 22, and 23 through vertical folding lines 17, 18, and 19 of the body. The inner container 5 has a body 26. A vertical direction sealing panel 25, which is continuously provided to the body panel 23 through a vertical folding line 24 of the seal, is coupled to an edge of the body panel 20 so that the body 26 is formed into a square tubular shape.

In this example, the upper surface 7 of the inner container 5 is configured as described below.

A pair of upper-surface forming panels 29 and 30, which face each other and overlap in the vertical direction, are continuously provided to upper edges of the body panels 20 and 22 through horizontal folding lines 27 and 28 of a top. Further, a sealing panel 31 for sealing an inner surface of the upper-surface forming panel 29 is continuously provided to an upper edge of the upper-surface forming panel 30, which underlies the upper-surface forming panel 29.

Further, a pair of side surface panels 34 and 35 are continuously provided to upper edges of the body panels 21 and 23 through horizontal folding lines 32 and 33 of the top. The pair of side surface panels 34 and 35 are positioned between the above-mentioned pair of upper-surface forming panels 29 and 30 to face each other, and folded along with overlapping of the pair of upper-surface forming panels 29 and 30.

Further, holes 9*a* and 9*b* being the suction port 8 are positioned and formed at centers of the upper-surface forming panels 29 and 30, respectively. The holes 9*a* and 9*b* are opened so that a center of the hole 9*a* and a center of the hole 9*b* match with each other when the upper-surface forming panels 29 and 30 overlap. Further, a film 36, which is tearable, is provided to a back surface of the upper-surface forming panel 30 so as to seal the hole 9*b*. The suction tube 15 of the pump 6 is stuck into the film 36 so as to tear the film 36.

In this example, the film 36 configured to seal the hole 9*b* is provided to the back surface of the upper-surface forming panel 30, but not limited thereto. The film 36 may be provided to a front surface of the upper-surface forming panel 30, and may be provided to each of the front and back surfaces of the upper-surface forming panel 30.

A known film, such as polyethylene, polypropylene, polyester, or cellophane may be used as the film 36, but not particularly limited thereto. When the film 36 is a thermoplastic resin, the hole 9*b* formed in the upper surface portion forming panel 30 can be easily sealed by heat sealing.

In addition, aluminum foil, paper, or the like may be laminated on the film 36 in order to improve tearability, light-blocking property, oxygen barrier property, or the like.

The upper surface 7 of the inner container 5 is formed by the upper-surface forming panels 29 and 30 and the side surface panels 34 and 35 as described below. After the body 26 is formed, first, the upper-surface forming panel 30 is folded inwardly. Along with that, the side surface panels 34 and 35 are folded up to inner surface sides into a triangular shape, and an upper opening of the body 26 is closed by the upper-surface forming panel 30. Then, the sealing panel 31, which is continuously provided to the upper edge of the upper-surface forming panel 30, is bonded to the inner surface of the upper-surface forming panel 29 in an area of S1 so as to seal the inner container 5. Both side edges of the upper-surface forming panel 30 are bonded to the side surface panels 34 and 35, which have been folded up into a triangular shape, in an area of S2 so as to seal the inner container 5 (see FIG. 11).

Next, the side surface panels 34 and 35 are folded up outwardly (in directions indicated by the arrows in FIG. 11) so that the upper-surface forming panel 29 overlies the upper-surface forming panel 30 (see FIG. 12). The side surface panels 34 and 35, which have been folded up to protrude to an outside of the body 26, are folded downwardly (in directions indicated by the arrows in FIG. 12), and fixed to the body 26 with an adhesive or the like. Accordingly, the upper surface 7 is formed.

Further, in this example, the bottom surface 16 is configured as described below.

A pair of gable roof-shaped bottom surface forming panels 39 and 40, which face each other, are continuously provided to lower edges of the body panels 20 and 22 through horizontal folding lines 37 and 38 of the bottom. Outer sealing panels 41 and 42, which have a belt-like shape, are continuously provided to lower parts of the gable roof-shaped bottom surface forming panels 39 and 40.

Further, a pair of gable wall-shaped bottom surface forming panels 45 and 46, which face each other, are continuously provided to lower edges of the body panels 21 and 23 through horizontal folding lines 43 and 44 of the bottom. Inner sealing panels 47 and 48, which have a belt-like shape and a height smaller than that of the outer sealing panels 41 and 42, are continuously provided to lower parts of the gable wall-shaped bottom surface forming panels 45 and 46.

Further, the bottom surface 16 is formed by the gable roof-shaped bottom surface forming panels 39 and 40 and the gable wall-shaped bottom surface forming panels 45 and 46 as described below. The gable wall-shaped bottom surface forming panels 45 and 46 are folded in between the gable roof-shaped bottom surface forming panels 39 and 40, and facing surfaces of the outer sealing panels 41 and 42, which face each other, are bonded to each other to seal the inner container 5. Further, facing surfaces of the outer sealing panels 41 and 42 and facing surfaces of the inner sealing panels 47 and 48, and facing surfaces of the inner sealing panels 47 and 48 are bonded to each other to seal the inner container 5. Accordingly, the bottom surface 16 is formed into a reversed quadrangular pyramid shape of a so-called reversed gable top shape.

As described above, according to the refillable container 1 of the present invention, the suction port 8 of this example, which is formed in the upper surface 7 of the inner container 5, is formed at the center of the upper surface 7. Thus, the pump 6, which is configured to pump up the liquid content in the inner container 5 accommodated in the outer container 3 and to dispense the liquid content to the outside, is provided at a center of the lid member 4 of the outer container 3. In thus manner, irrespective of an orientation of the lid member 4 configured to close the opening 2 of the outer container 3, when the opening 2 of the outer container 3 is closed by the lid member 4, the suction tube 15 arranged below the lid member 4 is reliably inserted from the suction port 8, which is formed in the upper surface 7 of the inner container 5, into the inner container 5.

The inner container 5 of this example is made of a paper material having a thermoplastic resin laminated on its both surfaces, and includes the four body panels 20, 21, 22, and 23. The inner container 5 has the body 26, which has an edge coupled to the vertical direction sealing panel 25 so as to be formed into a square tubular shape. As for the upper surface 7, the pair of upper-surface forming panels 29 and 30 and the pair of side surface panels 34 and 35 are continuously provided to the upper edges of the body panels 20, 21, 22, and 23. The pair of upper-surface forming panels 29 and 30 face each other and overlap in the vertical direction. The pair of side surface panels 34 and 35 are positioned between the upper-surface forming panels 29 and 30 so as to face each other, and folded up along with the overlapping of the upper-surface forming panels 29 and 30. The holes 9*a* and 9*b* being the suction port 8 are positioned and formed at the centers of the upper-surface forming panels 29 and 30. Thus, the suction port 8 can easily be formed at the center of the upper surface 7 of the inner container 5.

Further, the hole 9*b*, which is formed in the lower upper-surface forming panel 30, is sealed by the film 36, which is tearable. A periphery of the upper-surface forming panel 30 underlying the upper-surface forming panel 29, the upper-surface forming panel 29 overlying the upper-surface forming panel 30, and the side surface panels 34 and 35 are bonded to each other to seal the inner container 5. Accordingly, the liquid content is under a state of being sealed in the inner container 5. The opening 2 of the outer container 3 is closed by the lid member 4 so that the suction tube 15 arranged below the lid member 4 can be inserted from the suction port 8, which is formed in the upper surface 7 of the inner container 5, into the inner container 5.

Further, the bottom surface 16 of the inner container 5 of this example is formed into a reversed quadrangular pyramid shape. Thus, when the liquid content in the inner container 5 is reduced to a small amount, the liquid content is accumulated in an apex of the reversed quadrangular pyramid shape in the bottom surface 16. When the opening 2 of the outer container 3 is closed by the lid member 4 and the suction tube 15 arranged below the lid member 4 is inserted into the inner container 5, the distal end of the suction tube 15 is set to be positioned at the apex of the reversed quadrangular pyramid shape in the bottom surface 16 of the inner container 5. In this manner, the liquid content in the inner container 5 is reliably and thoroughly sucked out.

In the bottom surface 16 having the above-mentioned shape, in this example, the pair of gable roof-shaped bottom surface forming panels 39 and 40, which face each other, are continuously provided to the lower edges of the body panels 20, 21, 22 and 23. The pair of gable roof-shaped bottom surface forming panels 39 and 40 have the outer sealing panels 41 and 42, which have a belt-like shape, provided to their lower parts. The pair of gable wall-shaped bottom surface forming panels 45 and 46, which face each other, are continuously provided. The pair of gable wall-shaped bottom surface forming panels 45 and 46 have the inner sealing panels 47 and 48, which have a belt-like shape and a height smaller than that of the outer sealing panels 41 and 42. The gable wall-shaped bottom surface forming panels 45 and 46 are folded in between the gable roof-shaped bottom surface forming panels 39 and 40, and the facing surfaces of the outer sealing panels 41 and 42, which face each other, are bonded to each other to seal the inner container 5. Further, the facing surfaces of the outer sealing panels 41 and 42 and the facing surfaces of the inner sealing panels 47 and 48, and the facing surfaces of the inner sealing panels 47 and 48 are also bonded to each other to seal the inner container 5. Thus, the bottom surface 16 of the inner container 5 can easily be formed into a reversed quadrangular pyramid shape.

Further, in the refilling of the liquid content through use of the inner container 5 of this example, the action of disconnecting the lid member 4 from the outer container 3 and the action of taking out the suction tube 15 of the pump 6 provided to the lid member 4 from the inner container 5 can be performed through the single action of disconnecting the lid member 4 from the outer container 3.

Further, the inner container 5 of this example is also made of paper. Thus, the inner container 5 is recyclable, and hence the present invention can contribute to resource saving.

REFERENCE SIGNS LIST

1 refillable container
2 opening
3 outer container
4 lid member
4*a* fitting portion
5 inner container
6 pump
7 upper surface
8 suction port
9, 9*a*, 9*b* hole
10 film
11 sealing piece
12 perforations
13 tubular cylinder portion
14 dispense nozzle
15 suction tube
16 bottom surface
17, 18, 19 vertical folding line of body
20, 21, 22, 23 body panel
24 vertical folding line of seal
25 vertical direction sealing panel
26 body
27, 28 horizontal folding line of top
29, 30 upper-surface forming panel
31 sealing panel
32, 33 horizontal folding line of top
34, 35 side surface panel
36 film
37, 38 horizontal folding line of bottom
39, 40 gable roof-shaped bottom surface forming panel
41, 42 outer sealing panel
43, 44 horizontal folding line of bottom
45, 46 gable wall-shaped bottom surface forming panel
47, 48 inner sealing panel

The invention claimed is:

1. A refillable container, comprising:

an outer container, which has an opening on an upper part thereof and is made of plastic;

a lid member, which is configured to close the opening of the outer container and is made of plastic;

an inner container, which is made of paper, configured to store a liquid content therein, and replaceably accommodated in the outer container when the liquid content is used up, the inner container having a suction port formed in an upper surface of the inner container; and a pump, which is provided to the lid member and configured to pump up from the suction port the liquid content in the inner container accommodated in the outer container and to dispense the liquid content to an outside of the refillable container, wherein the inner container is made of a paper material having a thermoplastic resin laminated on both surfaces of the inner container, includes four body panels, and has a body, which has an edge coupled to a vertical direction sealing panel so as to be formed into a square tubular shape, wherein, in the upper surface of the inner container, a pair of upper-surface forming panels and a pair of side panels are continuously provided to upper edges of the four body panels, wherein the pair of upper-surface forming panels face each other and overlap in the vertical direction, wherein the pair of side panels are positioned between the pair of upper-surface forming panels to face each other and folded up outwardly from the pair of upper-surface forming panels along with overlapping of the pair of upper-surface forming panels, wherein the pair of upper-surface forming panels have holes, which are formed at centers of the pair of upper-surface forming panels to form the suction port, wherein one of the holes, which is formed in at least a lower upper-surface forming panel of the pair of upper-surface forming panels, is sealed by a film, which is tearable, wherein a periphery of the lower upper-surface forming panel of the pair of upper-surface forming panels, an upper upper-surface forming panel of the pair of upper-surface forming panels, and the pair of side panels are bonded to each other to seal the inner container, wherein a bottom surface of the inner container is formed into a reversed quadrangular pyramid shape, wherein the pump comprises:

a tubular cylinder portion;

a dispense nozzle, which is provided to an upper part of the tubular cylinder portion and serves also as an operation portion for a piston that is slidably fitted into the tubular cylinder portion; and a suction tube, which is provided to a lower part of the tubular cylinder portion, wherein the tubular cylinder portion penetrates the lid member, and is fixed to the lid member, wherein the dispense nozzle is arranged above the lid member, and the suction tube is arranged below the lid member, wherein the suction port, which is formed in the upper surface of the inner container accommodated in the outer container, an apex of the reversed quadrangular pyramid shape, which is formed in the bottom surface, and the suction tube, which is arranged below the lid member, are arranged to be positioned on the same imaginary line in a vertical direction of the refillable container, wherein, when the opening of the outer container is closed by the lid member, the suction tube arranged below the lid member is inserted from the suction port, which is formed in the upper surface of the inner container, into the inner container, and wherein the suction tube of the pump has a length so that a distal end of the suction tube is positioned at a vicinity of the apex of the reversed quadrangular pyramid shape in the bottom surface of the inner container when the opening of the outer container is closed by the lid member.

2. A refillable container according to claim 1, wherein, in the bottom surface of the inner container, a pair of gable roof-shaped bottom surface forming panels and a pair of gable wall-shaped bottom surface forming panels are continuously provided to lower edges of the four body panels, wherein the pair of gable roof-shaped bottom surface forming panels face each other, and have outer sealing panels, which have a belt-like shape, at lower portions thereof, wherein the pair of gable wall-shaped bottom surface forming panels face each other, and have inner sealing panels, which have a belt-like shape and a height smaller than that of the outer sealing panels, wherein the pair of gable wall-shaped bottom surface forming panels are folded in between the pair of gable roof-shaped bottom surface forming panels, and facing surfaces of the outer sealing panels, which face each other, are bonded to each other to seal the inner container, and wherein facing surfaces of the outer sealing panels and the inner sealing panels, and facing surfaces of the inner sealing panels are bonded to each other to seal the inner container.

* * * * *